US007118463B1

(12) United States Patent
Chen

(10) Patent No.: US 7,118,463 B1
(45) Date of Patent: Oct. 10, 2006

(54) SAND BLASTING MACHINE

(76) Inventor: Po-Hung Chen, No. 33, Chung Cheng Road, Yuan-Lin (TW)

( * ) Notice: Subject to any disclaimer, the term of this patent is extended or adjusted under 35 U.S.C. 154(b) by 0 days.

(21) Appl. No.: 11/333,406

(22) Filed: Jan. 18, 2006

(51) Int. Cl.
*B24C 9/00* (2006.01)
*B24C 3/00* (2006.01)

(52) U.S. Cl. ..... 451/89; 451/90; 451/87

(58) Field of Classification Search ..... 451/87, 451/88, 89, 90, 91, 75
See application file for complete search history.

(56) References Cited

U.S. PATENT DOCUMENTS 4,098,033 A * 7/1978 Mann ..... 451/89
4,300,318 A * 11/1981 Brown ..... 451/88
5,143,102 A * 9/1992 Blaul ..... 134/58 R
6,004,190 A * 12/1999 Trampusch ..... 451/89
6,364,748 B1 * 4/2002 Zwicker et al. ..... 451/38
6,712,677 B1 * 3/2004 Williams et al. ..... 451/89
6,878,046 B1 * 4/2005 Publ et al. ..... 451/89

* cited by examiner

*Primary Examiner*—Dung Van Nguyen
(74) *Attorney, Agent, or Firm*—Troxell Law Office, PLLC

(57) ABSTRACT

A sand blasting machine consists of a working chest and an air compressor that are coupled together. The working chest includes a casing, a upper lid, a nozzle holding dock, a nozzle, an air discharge filter device, an actuation switch, a left glove operation means and a right glove operation means. The air compressor includes an air compressor body, a return tube and a foot frog. By means of these elements, the air compressor and the working chest are coupled together in an integrated manner. Hence carrying and transportation are easier. Sand blasting operation can be performed flexibly without site constraint.

10 Claims, 8 Drawing Sheets

SAND BLASTING MACHINE

BACKGROUND OF THE INVENTION

1. Field of the Invention

The invention relates to a sand blasting machine and particularly to a sand blasting machine that includes an air compressor and a working chest coupled together in an integrated manner and is easy to transport and operable without site constraint to do sand blasting operation.

2. Description of the Prior Art

Jewelry, artifacts, high price ornamental articles and the like usually require sand blasting to treat the surface to enhance the appealing and product value. Sand blasting equipment generally includes a closed working chamber and an air tube to receive compressed air from a remote air compressor that is ejected through a nozzle to perform sand blasting operation. Some even have a sealed steel chest to serve as the sand blasting working chamber. They all have to connect to the remote air compressor to receive the air as the driving power of sand blasting. And a foot-stepping switch is used to control the air to enter the nozzle.

The conventional equipment mentioned above still have shortcomings, notably:

1. The working chamber cannot be moved easily, and the steel chest is heavy and difficult to move. Hence work pieces have to be transported frequently. This increases labor cost.
2. The air compressor is located outdoors at a remote location. The air delivery tube is lengthy. The cost of the equipment is higher. Moreover, air resistance coefficient is greater and results in waste of energy. To stabilize the air delivery pressure, an air tank is needed. This also increases the cost and takes more space.
3. To control air intake through the foot-stepping switch on the ground surface often causes mistaken triggering by operators. Accidents are prone to take place.

SUMMARY OF THE INVENTION

In view of the aforesaid disadvantages, the present invention aims to provide a sand blasting machine that is easy to assemble and transport, and operable without site constraint. It includes a working chest and an air compressor that are coupled together. The working chest includes a casing, a upper lid, a nozzle holding dock, a nozzle, an air discharge filter device, an actuation switch, a left glove operation means and a right glove operation means. The air compressor includes an air compressor body, a return tube and a foot frog. By means of these elements, the air compressor and the working chest can be coupled together in an integrated manner. Hence carrying and transportation is easier. Sand blasting operation can be performed flexibly without site constraint.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
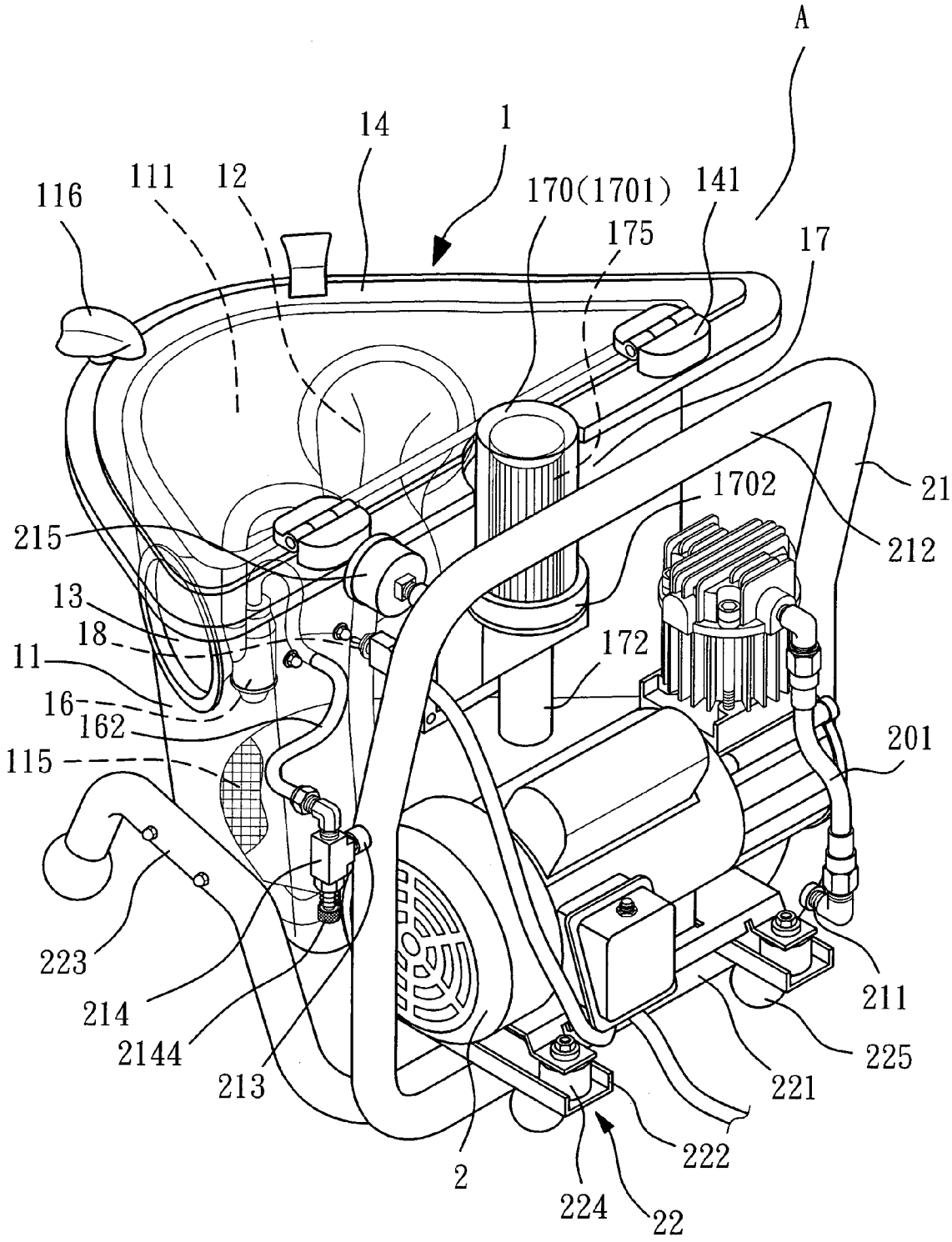
FIG. 1 is a perspective view of the invention.
Figure 2:
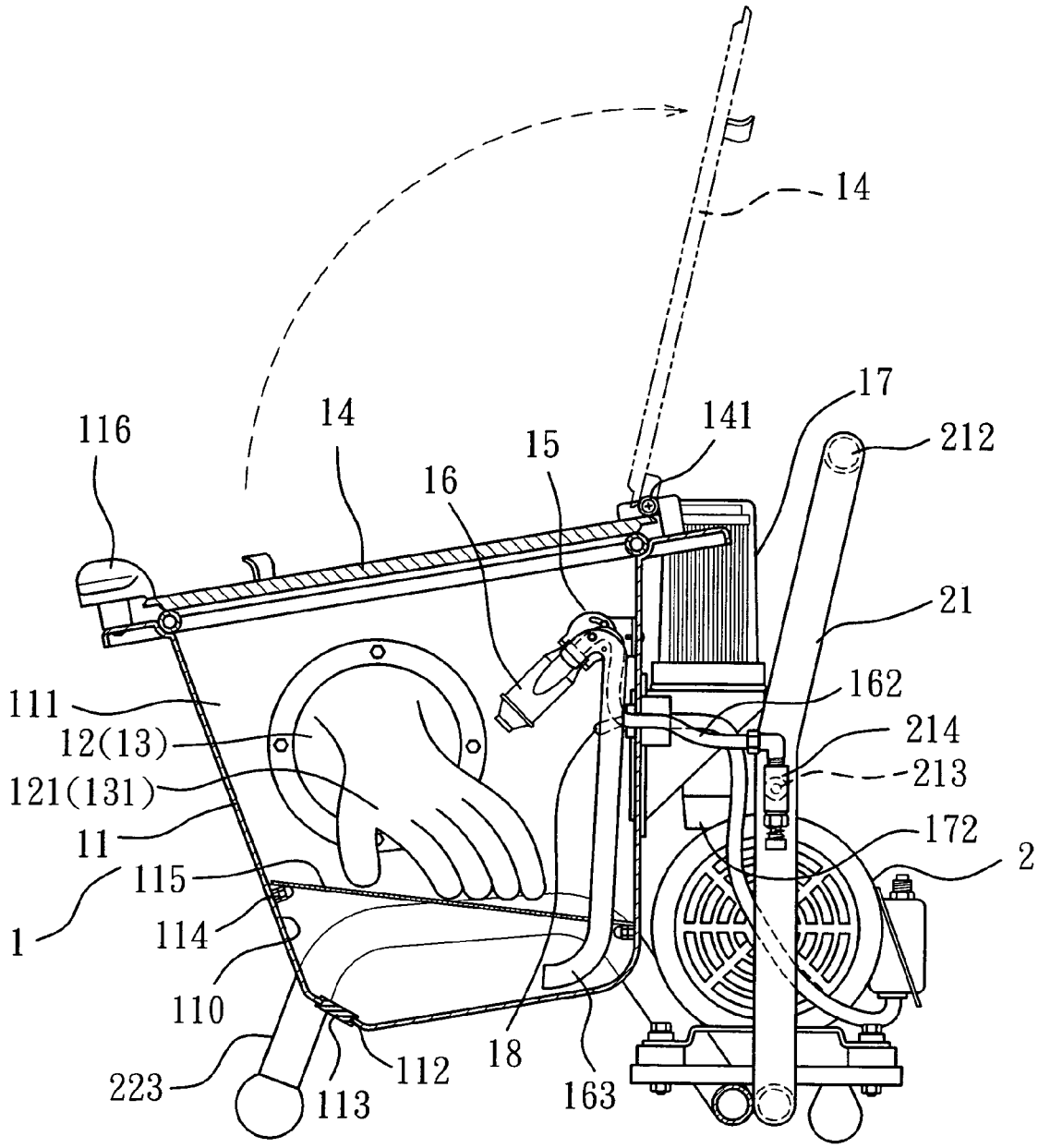
FIG. 2 is a sectional view of the invention.
Figure 3:
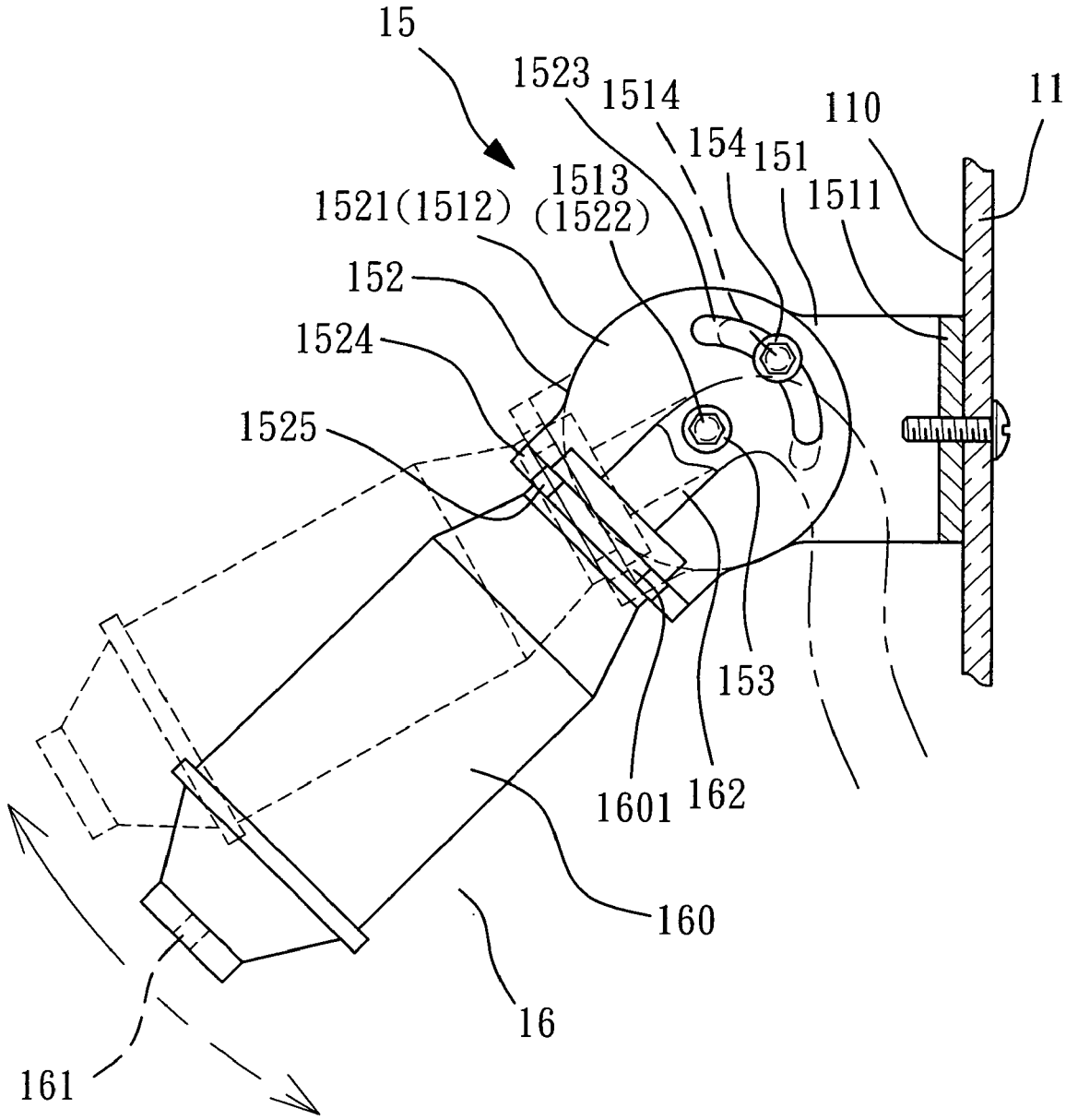
FIG. 3 is a schematic view of the invention for adjusting the sand blasting holding dock.
Figure 4:
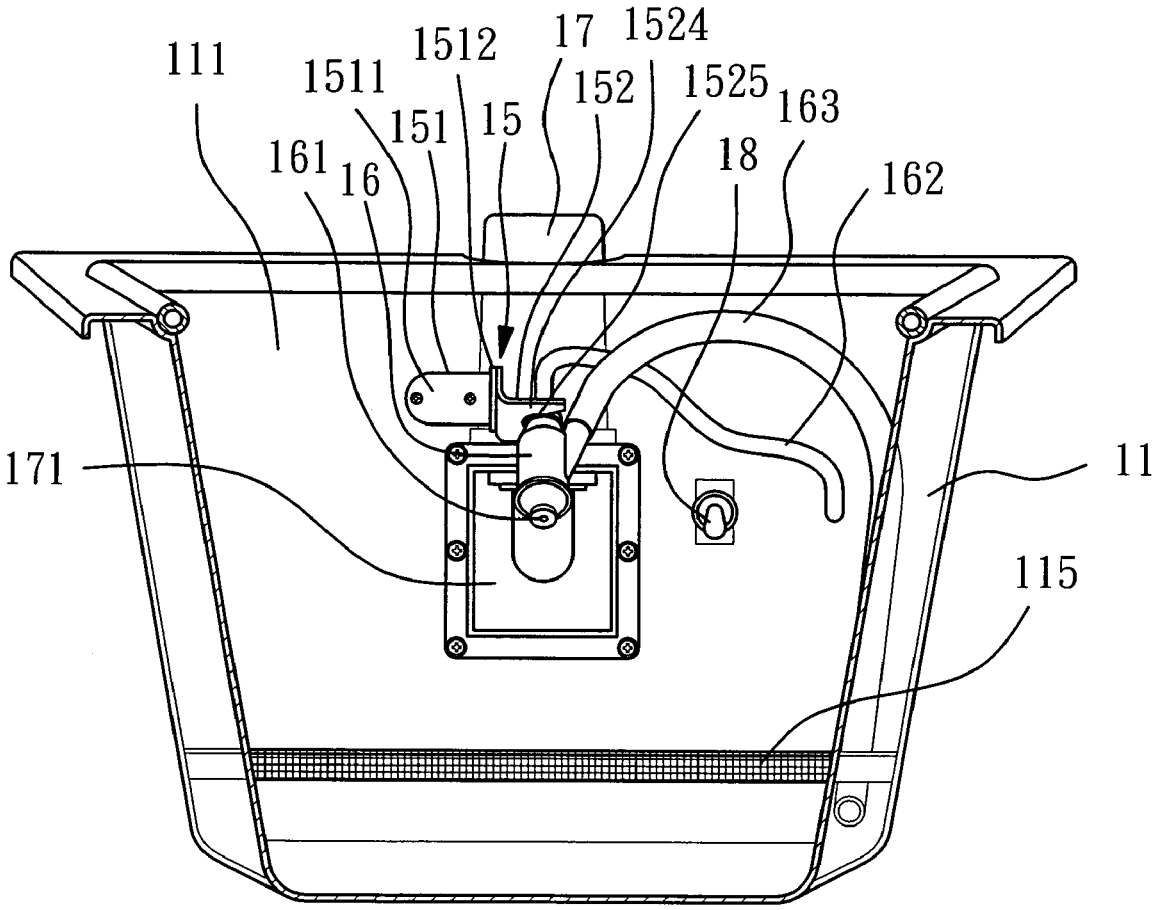
FIG. 4 is a fragmentary front view of the invention.
Figure 5:
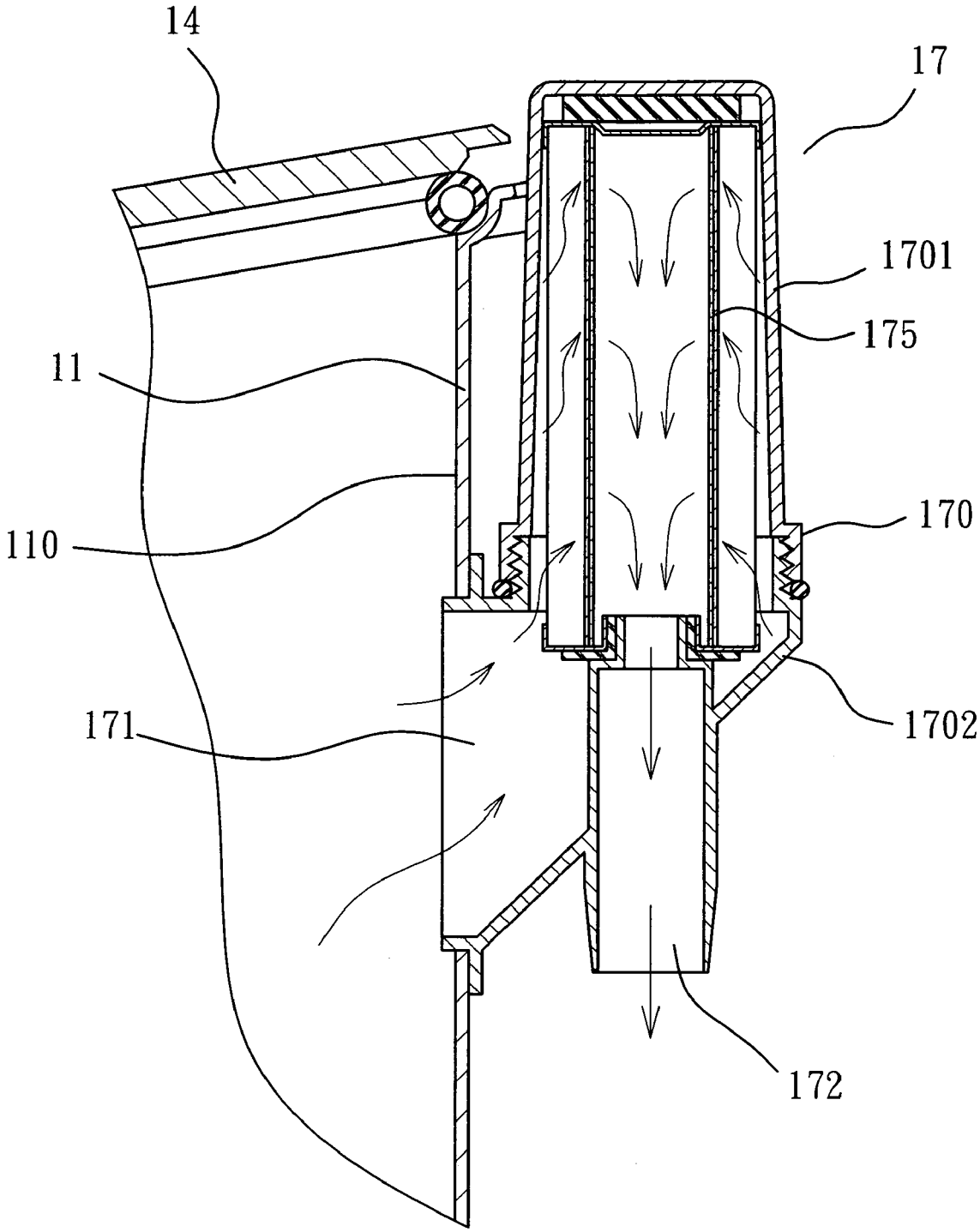
FIG. 5 is a fragmentary sectional view of the air discharge filter device of the invention.

Referring to FIGS. 1 through 5, the sand blasting machine A according to the invention includes a working chest 1 and an air compressor 2 that are coupled together.

The working chest 1 is made of a transparent material to receive light so that sand blasting operation can be seen from outside to facilitate operation.

The working chest 1 includes:

- a casing 11 which has a housing chamber 111 made of a transparent material, an opening 112 on the bottom to be sealed by a plug 113, an inner wall 110 with a plurality of anchor struts 114 formed on the periphery to brace a mesh 115, a left glove operation means 12 and a right glove operation means 13 on two sides;
- a upper lid 14 which is transparent and has an axle 141 on one end to be hinged on one side of the casing 11 and a latch element 116 to fasten the upper lid 14 and the casing 11 when they are coupled and closed. The upper lid 14 has an inner side covered by a transparent protection membrane. In the event that the protection membrane is bombarded by the sands during sand blasting operation and the visibility degrades, the protection membrane can be removed and replaced;
- a nozzle holding dock 15 which includes a holding plate 151 and a clipping plate 152. The holding plate 151 has a first end 1511 hinged on the inner wall 110 of the casing 11 and a second end 1512 which is circular and has an axle hole 1513 in the center, and a holding aperture 1514 on one side. The clipping plate 152 has a second end 1524 to form a notch 1525, and a first end 1521 which is circular and has a spindle hole 1522 in the center to receive a spindle 153 which also is pivotally coupled with the axle hole 1513 of the holding plate 151. The clipping plate 152 further has an arched slot 1523 on one side of the first end 1521 corresponding to the holding aperture 1514 to couple with a bolt 154 to adjust the angle of sand blasting;
- a nozzle 16 which has an air outlet 161 located on the juncture of distal ends of an air tube 162 and a sand tube 163. It has a body 160 with a groove 1601 formed on the periphery to be clipped by the notch 1525 of the nozzle holding dock 15;
- an air discharge filer device 17 which has an air discharge port 171 on the inner wall 110 of the casing 11 and a box 170 coupling with the air discharge port 171 from outside. The box 170 is located outside the casing 11 and has an air exit 172. The box 170 consists of a transparent upper deck 1701 and a base 1702 that are fastened together to house a filter 175; and
- an actuation switch 18 which is located on the inner wall 110 of the casing 11 close to the left glove operation means 12 or the right glove operation means 13, and is covered by a layer of dust guarding sleeve to prevent sands from entering.

Figure 6:
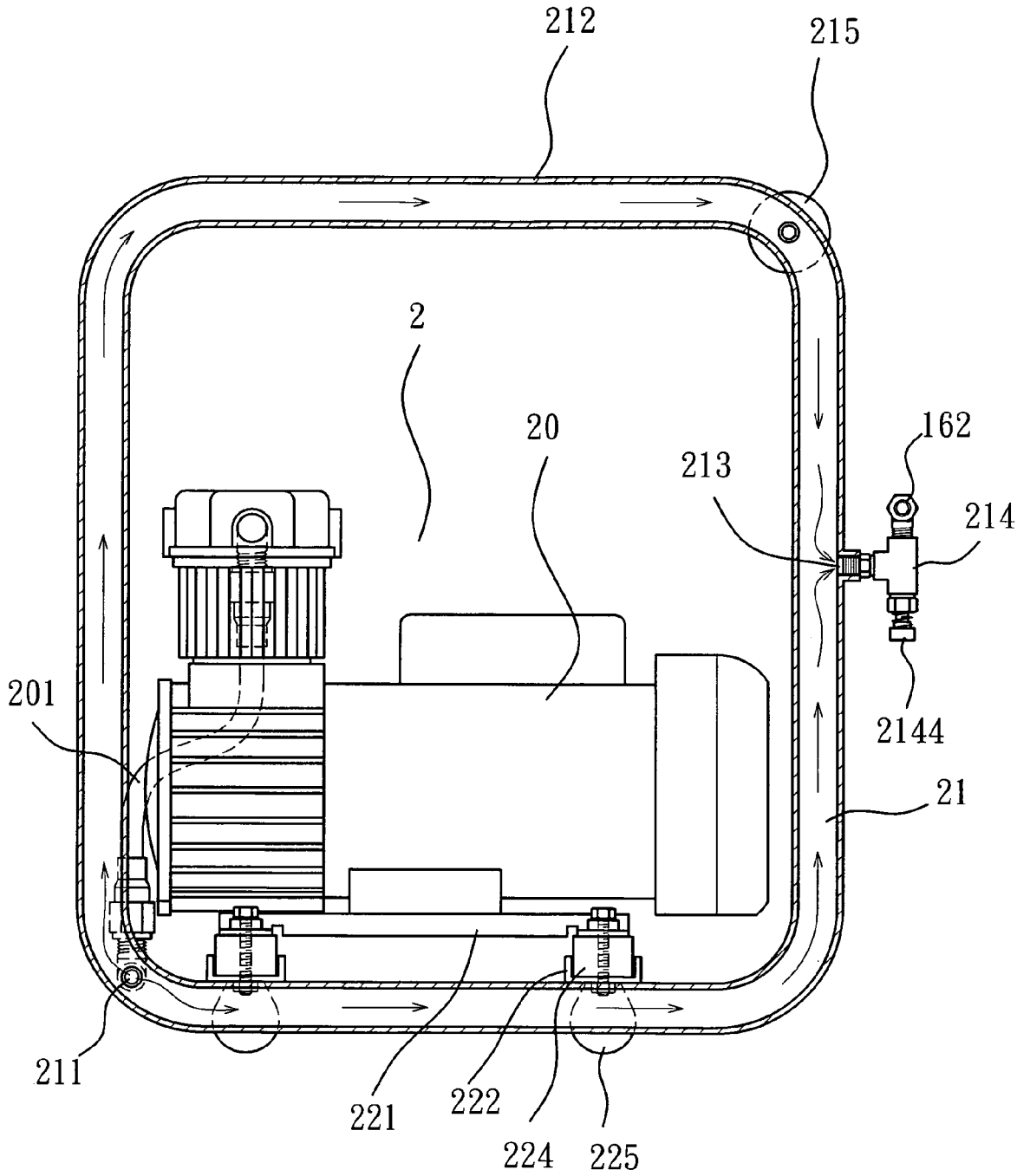
FIG. 6 is a schematic view of the invention showing the return tube in an operating condition.
Figure 7:
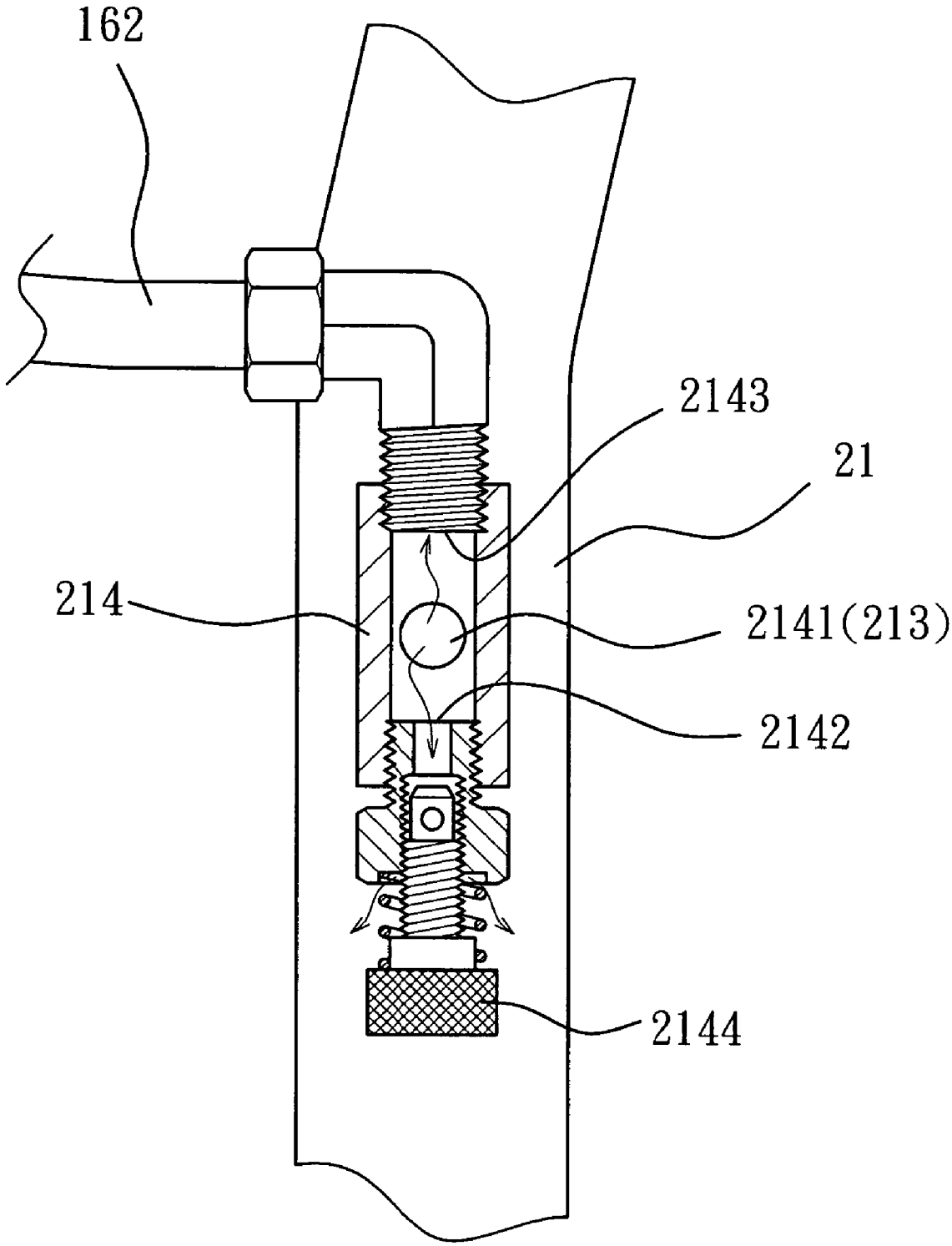
FIG. 7 is a fragmentary schematic view of the three-way valve on the return tube.

The air compressor 2 includes (referring to FIGS. 1, 2 and 6):

an air compressor body 20 which is driven by a motor to supply air (this is a device known in the art, thus details are omitted) and is connected to an air discharge tube 201 to output air;

a return tube 21 which surrounds the periphery of the air compressor 20 and is a closed pipe formed by a hollow metal tube. It aims to store the air and stabilize air pressure. It has an air intake end 211 to couple with the air discharge tube 201 and a horizontal and transverse handgrip portion 212 on a upper portion to be grasped as a handle during transportation, and an air exit end 213 on one side coupling with a three-way valve 214. The three-way valve 214 has a first port 2141 connecting to the air exit end 213, a second port 2142 connecting to a regulation bolt 2144 to adjust the air pressure, and a third port 2143 to connect to the air tube 162. There is also a pressure gauge 215 close to the three-way valve 214; and a foot frog 22 which is coupled with the bottom of the air compressor body 20, and includes a baseboard 221, two U-shaped boards 222, a pair of front brackets 223 coupling with the return tube 21, and a plurality of cushion pads 224 and 225 to reduce vibration during operation of the air compressor.

Figure 8:
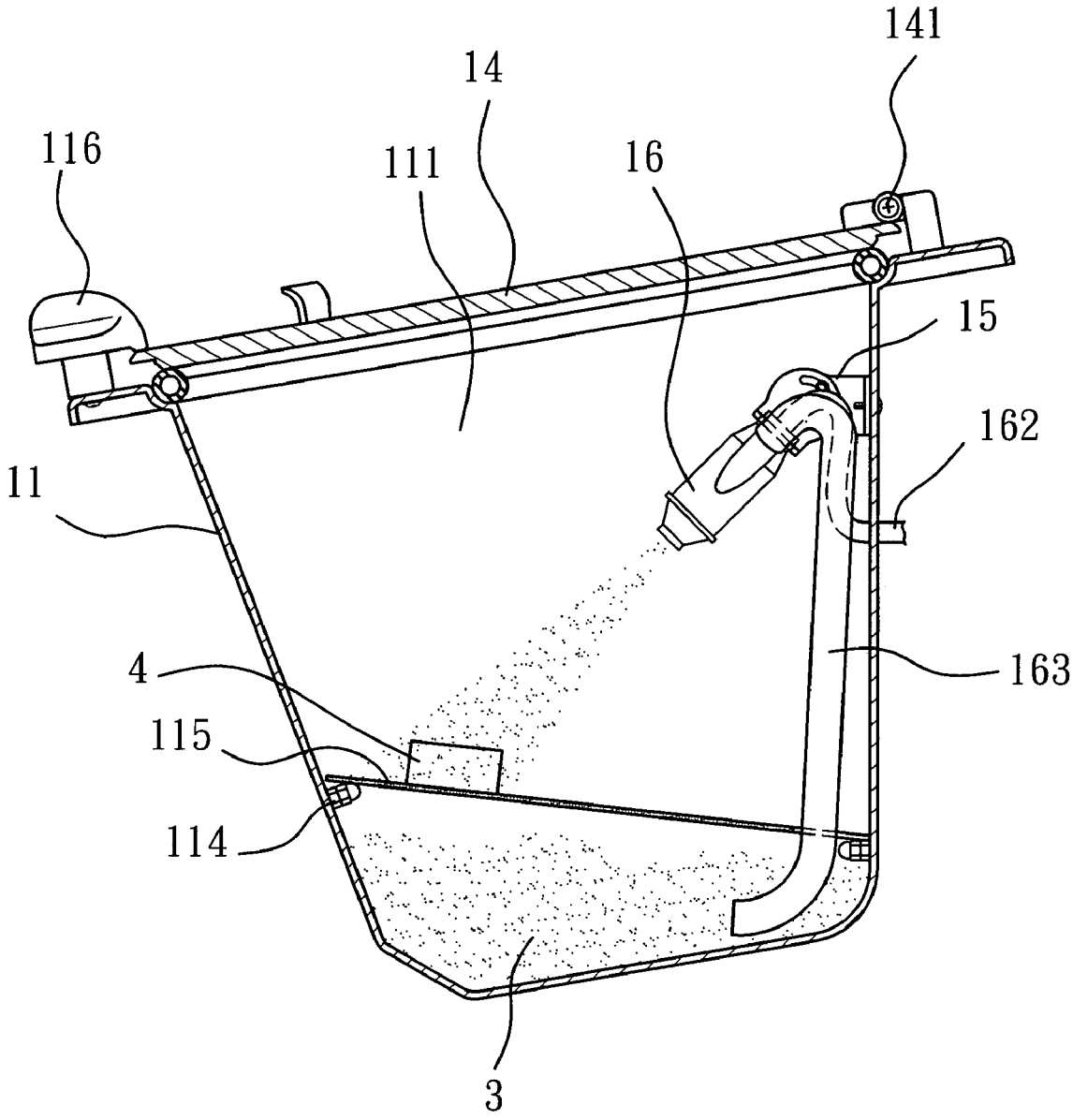
FIG. 8 is a schematic view of the invention in a sand blasting condition.

By means of the construction set forth above, when in use, first, pour sands 3 into the casing 11; place a working piece 4 on the mesh 115 (as shown in FIG. 8); cover the upper lid 14 and fasten the latch element 116; an operator puts his/her both hands into gloves 121 and 132 of the left glove operation means 12 and the right glove operation means 13; turn on the actuation switch 18 to start operation of the air compressor 2; air is delivered from the air discharge tube 201 to the return tube 21; as the air compressor 2 delivers the air in a reciprocal suction and pumping manner, unstable air pressure occurs; to remedy this problem, this invention first sends the air into the return tube 21 so that when the air flows through the return tube, counter flow takes place and the air is stabilized when delivered; the air is ejected through the air tube 162 and the nozzle 16. Meanwhile, the working chest 1 has a suction airflow to draw the sands 3 into the sand tube 163; the sands 3 are ejected through the air outlet 161 of the nozzle 16. The ejecting sands 3 bombard the surface of the work piece 4 to form uniform sand traces after a period of operation time. After the sand blasting operation is finished, turn off the actuation switch 18. During the sand blasting operation, the ejecting air is discharged through the air discharge port 171 and the discharged air contains a portion of the sands 3 that are filtered out by the filter 175 so that they are not directly discharged outside the working chest 1. The filter 175 is visible so that the operator can constantly monitor whether clogging happens. Clearing and replacement of the filter can be done whenever clogging occurs.

Moreover, beside holding the nozzle 16 with hands to target the work piece 4 to perform sand blasting operation, the nozzle can also be held by the notch 1525 of the nozzle holding dock 15. To adjust the angle of sand blasting, unfasten the bolt 154 and turn about the spindle 153, the bolt 154 can be moved along the arched slot 1523 until reaching a desired location; then fasten the bolt 154 to finish angular adjustment of sand blasting.

In summary, the invention can achieve the following benefits:

1. The air compressor and the working chest are coupled together in an integrated manner. Carrying and transportation are easier. It also can be operated without site constraint. Hence it can be moved as desired according to the location of the work piece.
2. The actuation switch is located in the working chest and can be activated more conveniently. The problems of inconvenient operation and mistaken triggering occurred to the conventional foot-stepping switch are resolved.
3. The actuation switch is covered by a dust guarding sleeve. This can prevent the sands from seeping into the switch.
4. The air discharge filter device is located outside the casing. It is easy to see whether clogging takes place and clearing is more convenient. It also can prevent the sands from dispelling outside and avoid environmental pollution.
5. The return tube can stabilize air pressure during air delivery. It saves the cost of air tank. The return tube further can serve as a handle to reduce total size.
6. No external pressure regulation device is needed. By adjusting the regulation bolt, air pressure can be adjusted rapidly.
7. The foot frog provides a cushion structure to reduce vibration of the sand blasting machine during operation.
8. The working chest is transparent and allows light to pass through. Hence sand blasting operation can be seen from outside to save energy.

I claim:

1. A sand blasting machine comprising a working chest and an air compressor, wherein:

the working chest includes:

a casing which has a housing chamber to hold a mesh and two sides for holding respectively a left glove operation means and a right glove operation means;

a upper lid which is made of a transparent material and has an axle on one end to be hinged on one side of the casing and a latch element to fasten the upper lid and the casing when they are coupled and closed;

a nozzle holding dock which includes a holding plate and a clipping plate;

a nozzle which has an air outlet on a front end on a juncture of distal ends of an air tube and a sand tube;

an air discharge filer device which has an air discharge port on an inner wall of the casing and a box coupling with the air discharge port from outside, the box being located outside the casing and having an air exit; and an actuation switch which is located on the inner wall of the casing close to the left glove operation means or the right glove operation means;

the air compressor includes:

an air compressor body which is driven by a motor to supply air and is connected to an air discharge tube to output the air;

a return tube which surrounds the periphery of the air compressor and is a closed pipe formed by a hollow metal tube, and has an air intake end to couple with the air discharge tube and an air exit end on one side; and a foot frog which is coupled with the bottom of the air compressor body.

2. The sand blasting machine of claim 1, wherein the holding plate has a first end hinged on an inner wall of the casing and a second end which is circular and has an axle hole in the center and a holding aperture on one side; and the clipping plate has another second end to form a notch to hold the nozzle and another first end which is circular and has a spindle hole in the center to receive a spindle which also is pivotally coupled with the axle hole of the holding plate, the clipping plate further has an arched slot on one side of the another first end corresponding to the holding aperture of the holding plate to couple with a bolt to adjust the angle of sand blasting.

3. The sand blasting machine of claim 1, wherein the actuation switch is covered by a layer of a dust guarding sleeve.

4. The sand blasting machine of claim 1, wherein the foot frog includes a baseboard, two U-shaped boards, a pair of front brackets coupling with the return tube and a plurality of cushion pads.

5. The sand blasting machine of claim 1, wherein the box of the air discharge filer device includes a transparent upper deck and a base to house a filter.

6. The sand blasting machine of claim 1, wherein the return tube has an air exit end to couple with a three-way valve.

7. The sand blasting machine of claim 6, wherein the three-way valve has a first port connecting to the air exit end.

8. The sand blasting machine of claim 6, wherein the three-way valve has a second port connecting to a regulation bolt.

9. The sand blasting machine of claim 6, wherein the three-way valve has a third port connecting to the air tube.

10. The sand blasting machine of claim 6, wherein the return tube has a pressure gauge.

* * * * *